US005398814A

United States Patent [19]

Sime

[11] Patent Number: 5,398,814

[45] Date of Patent: Mar. 21, 1995

[54] GRANULAR MATERIAL CONVEYING APPARATUS WITH PERFORATED CENTER TUBE

[76] Inventor: Sylvan H. Sime, R.R. 138A, Kiester, Minn. 56051

[21] Appl. No.: 220,185

[22] Filed: Mar. 30, 1994

[51] Int. Cl.[6] ..... B07B 1/18

[52] U.S. Cl. ..... 209/285; 209/297

[58] Field of Search ..... 198/658, 662; 209/288, 209/293, 294, 296, 297, 298, 240, 241, 244, 245, 247, 270, 683, 285

[56] References Cited

U.S. PATENT DOCUMENTS

| | | | |
|---|---|---|---|
| 156,800 | 11/1874 | Kurth | 209/297 X |
| 1,220,197 | 3/1917 | Cowles | 209/285 X |
| 1,274,956 | 8/1918 | Taliaferro . | |
| 1,309,754 | 7/1919 | Doyel | 209/270 |
| 1,387,238 | 8/1921 | Cave | 209/270 |
| 1,533,997 | 4/1925 | Stinson | 209/296 |
| 1,948,606 | 2/1934 | Weinig | 209/288 |
| 2,131,128 | 9/1938 | Thornton | 209/285 X |
| 2,283,805 | 5/1942 | Gustafson | 209/285 |
| 2,784,948 | 5/1951 | Pahl et al. . | |
| 2,806,600 | 9/1957 | Bryan, Sr. et al. | 209/297 X |
| 2,838,177 | 6/1958 | Higgin | 209/285 X |
| 2,907,561 | 9/1957 | Newsom . | |
| 3,394,808 | 7/1968 | Thompson | 209/245 |
| 3,463,314 | 8/1969 | Feterl | 209/296 X |
| 3,483,975 | 12/1969 | Yetter | 209/297 |
| 3,502,200 | 5/1970 | Thobroe et al. . | |
| 3,756,406 | 9/1973 | Khan | 209/294 X |
| 3,867,104 | 2/1975 | Leybourne, III et al. . | |
| 3,978,978 | 9/1976 | Herter . | |
| 4,154,574 | 5/1979 | Keirle et al. | 209/296 X |
| 4,159,242 | 6/1979 | Walker | 209/270 X |
| 4,342,269 | 8/1982 | Hoskinson . | |
| 4,353,725 | 10/1982 | Hohman et al. | 209/285 X |
| 4,393,609 | 7/1983 | Persson . | |
| 4,684,458 | 8/1987 | Grotto | 209/241 X |
| 5,030,348 | 7/1991 | Bengt | 209/297 X |
| 5,076,704 | 12/1991 | Serbousek . | |

FOREIGN PATENT DOCUMENTS

| | | | |
|---|---|---|---|
| 167070 | 2/1934 | Switzerland | 209/285 |
| 234582 | 6/1925 | United Kingdom | 209/285 |
| 988699 | 4/1965 | United Kingdom | 209/288 |
| 336052 | 7/1972 | U.S.S.R. | 209/288 |
| 0950441 | 8/1982 | U.S.S.R. | 209/285 |

*Primary Examiner*—D. Glenn Dayoan
*Attorney, Agent, or Firm*—Kinney & Lange

[57] ABSTRACT

A granular material conveying system for conveying granular materials and filtering fine particles from the granular materials is configured for rotatably conveying granular materials about an axis in a longitudinal direction along the axis. The system includes a hollow center tube coaxially centered about the axis. The center tube includes an outlet, an exterior, an interior and a plurality of perforations communicating between the exterior and the interior. As the granular materials are rotatably conveyed along and around the center tube, fine particles from granular materials migrate through the perforations into the center tube and are thereby filtered from the granular material.

16 Claims, 1 Drawing Sheet

GRANULAR MATERIAL CONVEYING APPARATUS WITH PERFORATED CENTER TUBE

BACKGROUND OF THE INVENTION

The present invention relates to granular conveyors and auger systems for conveying granular materials. In particular, the present invention relates to a granular conveying auger system having a perforated center tube for filtering fine particles from the granular materials while conveying the granular materials.

Granular materials include a wide range and variety of small particles or pellets such as grains, animal feeds, chemical fertilizers and the like. During the processing or harvesting of such granular materials, the granular materials often become contaminated with foreign particles.

A typical example of such contamination occurs with the harvesting, storing and transport of grains such as corn, soybeans, wheat and oats. During harvest of these grains, the grains often become contaminated with foreign material including chaff, dirt and dust, insects and weed seed. Because of imperfect storing and transportation conditions, the grain is further contaminated by mold and fungus. As a result, this contamination lowers the overall purity and quality of the harvested grain.

Because many of the uses and processes involving granular material require relatively pure, high quality granular material, the foreign material and contaminates must be separated and removed. Typically, such a process involves transferring or conveying the granular material to a cleaning facility, washing the granular material or moving the granular material back and forth across a screen or filter and then conveying the granular material to a storage or processing location. This cleaning step requires additional equipment and space. The cleaning and purification of the granular material further delays the final end use of the granular material. As a result, removing the foreign material from the granular material is both time consuming and expensive.

In other cases, the preparation of animal feeds and food stuffs involves the grinding of grains and other granular materials into fine particles which are then used as part of a final end product. Similar to the purification process, grinding the granular material, filtering the fine particles from the granular material, and conveying the granular material and the fine particles to and from a separate site in separate steps requires additional capital equipment and time. Consequently, these filtering or separation processes are also time consuming and expensive.

SUMMARY OF THE INVENTION

The present invention is an improved granular conveying system. The granular material conveying system is configured for rotatably conveying granular materials about an axis in a longitudinal direction along the axis. The improved system includes a hollow center tube coaxially centered about the axis. The center tube includes an outlet, an exterior, an interior and a plurality of perforations communicating between the exterior and the interior. As the granular materials are rotatably conveyed along and around the center tube, fine particles from granular materials migrate through the perforations into the center tube and are thereby filtered from the granular material.

DETAILED DESCRIPTION OF THE PREFERRED EMBODIMENTS

Figure 1:
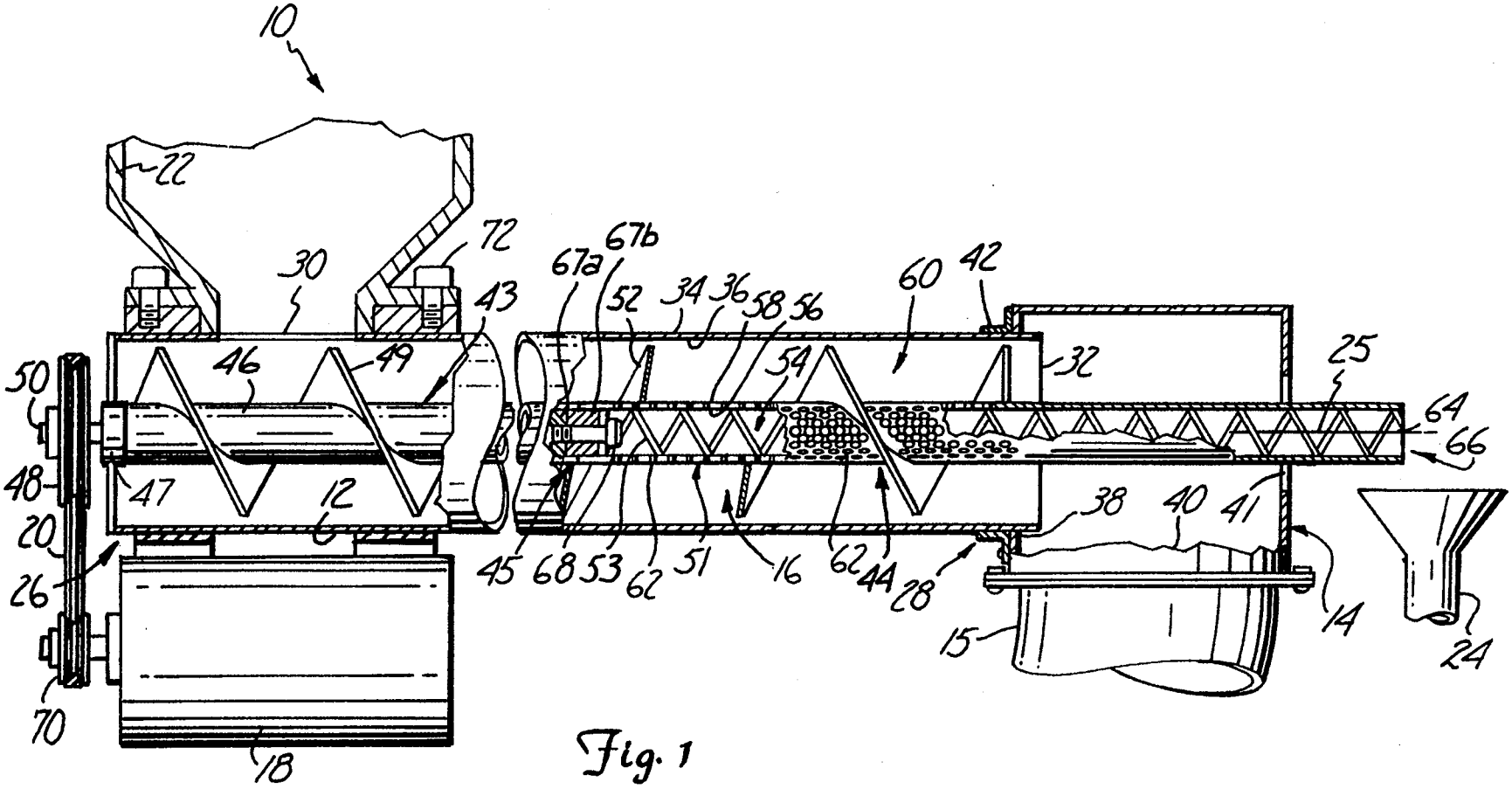
FIG. 1 is a cross-sectional view of an auger system of the present invention with some portions broken away and some portions shown in full.

FIG. 1 is a cross sectional view of granular conveying system 10 with some portions shown broken away and some portions shown in full for clarity. Granular conveying system 10 conveys granular materials and filters fine particles from the granular materials. Granular conveying system 10 generally includes outer tube 12, discharge chute 14, chute extension 15, auger assembly 16, motor 18, drive belt 20, hopper 22 and fines chute 24. Outer tube 12 is an elongated hollow tube centered about axis 25 and extending from an input end 26 to an output end 28. Outer tube 12 includes inlet 30, outlet 32, exterior surface 34 and interior surface 36. Inlet 30 generally consists of a hole communicating between exterior surface 34 and interior surface 36 of outer tube 12. Inlet 30 is centered at a bottom of hopper 22 at inlet or input end 26 of outer tube 12. Inlet 30 permits outer tube 12 to receive granular materials at input end 26 so they may be conveyed through outlet 32 at output end 28.

Outlet 32 comprises an axial opening at the output end 28 of outer tube 12. Alternatively, outlet 32 may comprise an opening through outer tube 12. Outlet-32 permits conveyed and filtered granular material to be discharged from outer tube 12 into discharge chute 14.

Discharge chute 14 is coupled to output end 28 of outer tube 12. Discharge chute 14 generally consists of a housing having an input opening 38, an output opening 40 and a far end opening 41. Input opening 38 has a diameter greater than or equal to the diameter of outer tube 12. Output opening 40 has a diameter sufficient to allow adequate flow of granular material through discharge chute 14. Discharge chute 14 is coupled to output end 28 of outer tube 12 so that the output end 28 of outer tube 12 extends through input opening 38. Discharge chute 14 is preferably mounted to outer tube 12 by bracket 42. Alternatively, discharge chute 14 may be secured to outer tube 12 by weld joints or various other coupling mechanisms as are known in the art. Discharge chute 14 encloses output end 28 of outer tube 12 and directs the granular material discharged from outer tube 12 through output opening 40 into extension chute 15.

Extension chute 15 preferably comprises a tubular member. Extension chute 15 is mounted to a lower end of discharge chute 14 below output opening 40 of discharge chute 14. Preferably, extension chute 15 has an interior which communicates with an interior of discharge chute 14 through output opening 40. Extension chute 15 further guides material discharged from outer tube 12. The length of extension chute 15 may be varied to provide as much guidance as is necessary.

Auger assembly 16 conveys the granular materials through outer tube 12 about axis 25 in a longitudinal direction along axis 25. Auger assembly 16 includes main auger 43, filtering auger 44 and coupling assembly 45. Main auger 43 includes center tube 46, bearing assembly 47, drive pulley 48 and spiral auger flight 49. Center tube 46 generally consists of a cylindrical tube coaxially extending within outer tube 12. Center tube 46 includes a drive shaft 50. Drive shaft 50 extends through bearing assembly 47.

Bearing assembly 47 consists of standard ball bearing components as are known in the art. Bearing assembly 47 rotatably couples center tube 46 of auger assembly 16 to a stationary mounting apparatus, outer tube 12. Auger assembly 16 is preferably centered within outer tube 12 by beating assembly 47. Bearing assembly 47 permits auger assembly 16 to be rotated while outer tube 12 remains stationary.

Drive pulley 48 generally consists of a circular pulley. Drive pulley 48 has a groove along its outer parameter sized to accommodate drive belt 20. Drive pulley 48 is fixedly secured to drive shaft 50 of center tube 46 by weld joints. Drive pulley 48 is preferably secured to center tube 46 near input end 26. Rotation of drive pulley 48 rotates center tube 46 so that auger assembly 16 is rotated to convey granular material and fine particles, respectively.

Exterior spiral auger flight 49 generally consists of a spiral vane extending around center tube 46 and filtering auger 44 from input end 26 near bearing assembly 47 to output end 28. Spiral flight 49 floats on the granular material being conveyed within interior surface 36 of outer tube 12 and forms a helical passageway around center tube 46 and filtering auger 44 within outer tube 12. Spiral flight 49 is preferably secured to an exterior surface of center tube 46 by welded joints. As a result, rotation of center tube 46 conveys filtered granular material between center tube 51 and outer tube 12 towards output end 28. As can be appreciated, other mechanisms may also be used to rotatably convey granular material around center tube 51.

Filtering auger 44 includes center tube 51 and interior spiral auger flight 53. Center tube 51 consists of a hollow cylindrical tube coaxially extending through auger flight 49 from center tube 46 through outer tube 12 and through discharge chute 14. In the preferred embodiment, center tube 51 is not fixedly secured to auger flight 49. Alternatively, center tube 51 may be secured to auger flight 49 by welded joints. Center tube 51 includes interior 54, interior surface 56, exterior surface 58, exterior 60, perforations 62 and center tube outlet 64. Interior 54 extends within center tube 51 and is defined by interior surface 56. Interior 54 has an inner diameter large enough to receive and convey fine particles filtered from the granular materials. Exterior surface 58 of center tube 51 and interior surface 36 of outer tube 12 define exterior 60 of center tube 51. Exterior 60 is preferably large enough to receive and convey unfiltered and filtered granular materials towards output end 28 of outer tube 12.

Perforations 62 consist of small openings extending from exterior surface 58 to interior surface 56 of center tube 51. Perforations 62 communicate between exterior 60 and interior 54 of center tube 51. Perforations 62 preferably have a diameter sufficient so as to permit fine particles within the granular material to move or flow from the granular material into interior 54. At the same time, perforations 62 preferably have a diameter small enough so as to prevent the granular materials themselves from moving or flowing through perforations 62 into interior 54. As can be appreciated, the size or the diameter of perforations 62 may be varied depending upon the particular granular material to be conveyed by granular conveying system 10 and the size and type of fine particles to be filtered from the granular materials. Perforations 62 preferably are positioned in portions of center tube 51 which are adjacent the last 12 or more inches of spiral auger flight 49. Perforations 62 are not positioned in the portion of center tube 51 which extends past outer tube 12 into discharge chute 14. Alternatively, perforations 62 may be extended in center tube 51 towards input end 26 of outer tube 12. Perforations 62 filter and separate fine particles from the granular material as the granular material is conveyed by auger assembly 16 within outer tube 12.

Outlet 64 is a radial opening at discharge end 66 of center tube 51. Alternatively, outlet 64 consists of an opening extending through center tube 51 and communicating between interior surface 56 and exterior surface 58. Outlet 64 permits the fine particles filtered from the granular material to be discharged from interior 54 of center tube 51. These fine particles may then be collected and used or disposed of as necessary.

Interior spiral auger flight 53 generally consists of a spiral vane extending within interior 54 of center tube 51. Interior spiral flight 53 is preferably secured to coupling assembly 45. Alternatively, auger flight 53 is secured to interior surface 56 of center tube 51 by welded joints. Auger flight 53 preferably extends from perforations 62 which are farthest away from discharge end 66 (coupling assembly 45) to discharge end 66. Alternatively, auger flight 53 may extend along an entire length of center tubes 46 and 51. As a result, rotation of center tube 46 and coupling assembly 45 also rotates spiral flight 53 to convey the fine particles filtered from the granular material from interior 54 of center tube 51 out outlet 64. Alternatively, spiral auger flight 53 may be secured to a separate, independent center tube within interior 54 of center tube 51. Rotation of the independent center tube would rotate auger flight 53 to convey the fine particles out outlet 64 at discharge end 66 of center tube 51. As can be appreciated, several other mechanisms or methods may also be used to discharge the fine particles out outlet 64 of center tube 51 including the use of vacuum, pressurized air, and the like.

Coupling assembly 45 secures filtering auger 44 to main auger 43 and includes plugs **67*a*, 67*b* and pin or bolt 68. Plugs 67*a* and 67*b* are fixedly secured within center tubes 46 and 51, respectively. Plug 67*a* is coupled to interior spiral auger flight 53 and is recessed within center tube 46 of auger 43. Plug 67*b* is partially secured within center tube 51 of auger 44 so that a portion of plug 67*b* projects beyond center tube 51 into center tube 46 when augers 43 and 44 are coupled together. As a result, plug 67*b* of coupling assembly 45 mates and aligns center tube 51 of auger 44 with center tube 46 of auger 43. In addition, because plug 67*b* extends between and across both center tube 46 and center tube 51, the junction between auger 43 and auger 44 is made stronger. Because plug 67*b* is coupled to auger flight 53, rotation of center tube 46 also rotates interior auger flight 53 to convey fine particles. Plugs 67*a* and 67*b* are preferably welded to an interior surface of center tubes 46 and 51**, respectively.

Bolt 68 extends through plugs **67*a*, 67*b* and couples center tube 46 to center tube 51. Bolt 68 preferably has exterior threads which threadably engage interior threads of plug 67*a*. Alternatively, other mounting or coupling structures may also be used to couple filtering auger 44 to an existing auger assembly. In addition, coupling assembly 45 blocks an end of center tube 51 to prevent the fine particles from falling or flowing beyond the point where auger flight 53** begins.

Coupling assembly 45 enables filtering auger 44 to be mounted to any existing auger assembly. As a result, any existing auger assembly or system may be easily modified to filter and remove fine particles or contaminants from granular material. For example, the center tube of an existing auger such as auger 43 may be cut off and shortened so that filtering auger 44 may be partially positioned within outer tube 12, through spiral auger flight 49, and coupled to the shortened center tube with coupling assembly 45. Alternatively, the entire end of an existing auger may be cut off and shortened so that filtering auger 44 additionally including a spiral flight secured to exterior surface 58 may be partially positioned within outer tube 12 and coupled to the shortened auger with coupling assembly 45. Filtering auger 44 may also be coupled to an existing, unshortened auger shaft with an additional outer tube auger flight and extension surrounding filtering auger 44 to effectively extend the length of the auger assembly while also filtering fine particles and contaminants from the granular material. As can be appreciated, filtering auger 44 may alternatively be integrally formed as part of main auger 43. In addition, auger assembly 16 may alternatively consist solely of filtering auger 44 and spiral auger flight 49.

Motor 18 is fixedly coupled to outer tube 12 and includes motor pulley 70. Motor pulley 70 extends from motor 18 towards drive pulley 48. Motor pulley 70 is circular and has an outer groove along its parameter sized to accommodate drive belt 20. Drive belt 20 generally consists of a band or belt. Drive belt 20 fits within the grooves of drive pulley 48 and motor pulley 70. Drive belt 20 partially encircles drive pulley 48 and motor pulley 70 to provide rotational communication between drive pulley 48 and motor pulley 70. Motor 18 rotates motor pulley 70 to rotate drive pulley 48 and center tubes 46 and 51 of auger assembly 16.

Hopper 22 generally consists of the conical shaped funnel which is positioned around inlet 30 of outer tube 12. Hopper 22 is preferably bolted to outer tube 12 by bolts 72. Alternatively, hopper 22 may be welded to outer tube 12. Hopper 22 funnels granular material through inlet 30 to spaces between outer tube 12 and auger assembly 16.

In operation, granular material containing foreign materials and contaminates is transferred to and is poured into hopper 22 where the granular material is funnelled through inlet 30 into the space between outer tube 12 and auger assembly 16. Motor 18 rotates center tubes 46 and 51 of auger assembly 16 to cause spiral auger flight 49 and interior spiral auger flight 53 to rotate. Exterior spiral auger flight 49 conveys the granular material from input end 26 towards output end 28. After being conveyed past coupling assembly 45 toward output end 28, the granular material is rotatably conveyed between center tube 51 and outer tube 12 around perforations 62. With a full or nearly full granular flow within outer tube 12, fine particles within the granular material migrate towards center tube 51. Perforations 62 permit fine particles to continue their migration into interior 54 of center tube 51. Thus, the fine particles or foreign contaminates are separated and removed from the granular material while the granular material is conveyed from input end 26 to output end 28. Filtered granular material is conveyed by spiral auger flight 49 until the grain is discharged out outlet 32 and through discharge chute 14 and chute extension 15. The fine particles which accumulate within interior 54 of center tube 51 are conveyed by spiral auger flight 53 to discharge end 66 of center tube 51. The contaminates or fine particles are then discharged out outlet 64 into fines chute 24 for later use or disposal.

In conclusion, granular conveying system 10 performs two functions at the same time. Granular conveying system 10 conveys granular material from one location to another location. At the same time, granular conveying system 10 effectively filters the granular material to remove foreign contaminates and fine particles from the granular material. Consequently, granular material may be more effectively filtered with less equipment and space at a lower cost and in less time.

Although the present invention has been described with reference to preferred embodiments, workers skilled in the art will recognize that changes may be made in form and detail without departing from the spirit and scope of the invention.

What is claimed is:

1. A granular conveying system for conveying granular materials and filtering fine particles from the granular materials, the system comprising:

an auger for conveying the granular materials and for filtering fine particles from the granular materials, the auger including:

a hollow center tube, the center tube having an outlet, an exterior, an interior and a plurality of perforations communicating between the exterior and the interior; and a spiral auger flight surrounding the exterior of the center tube so that rotation of the spiral auger flight conveys granular materials around the exterior of the center tube so that fine particles are filtered into the interior of the hollow center tube from the granular materials; and means for discharging fine particles from the interior of the center tube out the outlet of the center tube.

2. The granular conveying system of claim 1 further including an elongated outer tube coaxially positioned around the hollow center tube, the outer tube having an inlet for receiving granular material and an outlet for discharging filtered granular materials.

3. The granular conveying system of claim 1 including means coupled to the spiral auger flight for rotating the spiral auger flight.

4. The granular conveying system of claim 1 wherein the means for discharging comprises an interior spiral auger flight positioned within the interior of the center tube so that rotation of the interior spiral auger flight discharges fine particles from the interior of the center tube out the outlet of the center tube.

5. A granular conveying system for conveying granular materials and filtering fine particles from the granular materials, the system comprising:

a hollow center tube, the center tube having an outlet, an exterior, an interior and a plurality of perforations for communicating between the exterior and the interior;

an elongated outer tube coaxially surrounding the center tube, the outer tube having an inlet for receiving granular materials and an outlet for discharging filtered granular materials;

means coupled to the auger system for rotatably conveying granular materials between the center tube and the outer tube so that fine particles are filtered into the interior of the center tube; and means for discharging fine particles from the interior of the center tube out the outlet of the center tube.

6. The granular conveying system of claim 5 wherein the means for rotatably conveying comprises:

a spiral auger flight between the outer tube and the center tube; and means coupled to the spiral auger flight for rotating the spiral auger flight.

7. The granular conveying system of claim 6 wherein the means for rotating the spiral auger flight comprises a motor coupled to the spiral auger flight.

8. The granular conveying system of claim 5 wherein the means for discharging comprises:

an interior spiral auger flight within the center tube; and means coupled to the interior spiral auger flight for rotating the interior spiral auger flight.

9. A granular conveying system for conveying granular materials and filtering fine particles from the granular materials, the system comprising:

an elongated outer tube having an inlet for receiving granular materials and an outlet for discharging filtered granular materials;

an auger for conveying the granular materials within the outer tube and for filtering fine particles from the granular materials, the auger including: a hollow center tube coaxially positioned within the outer tube, the center tube having an outlet, an exterior, an interior and a plurality of perforations communicating between the exterior and the interior; and a spiral auger flight surrounding the exterior of the center tube; and means coupled to the spiral auger flight for rotating the spiral auger flight within the outer tube so that fine particles are filtered into the interior of the center tube; and means for discharging fine particles from the interior of the center tube out the outlet of the center tube.

10. The granular conveying system of claim 9 wherein the means for rotating comprises a motor coupled to the hollow spiral auger flight.

11. The granular conveying system of claim 9 wherein the means for discharging comprises:

an interior spiral auger flight within the interior of the hollow center tube; and means coupled to the interior spiral auger flight for rotating the interior spiral auger flight.

12. An auger attachment for being mounted to an existing auger having a rotatable center tube and a spiral auger flight, the attachment comprising:

a hollow center tube, the center tube having an outlet, an exterior, an interior, and a plurality of perforations for communicating between the exterior and the interior; and means for coupling the hollow center tube to the center tube of the existing auger so that granular material is rotatably conveyed about the hollow center tube to filter fine particles from the granular material.

13. The auger attachment of claim 12 wherein the means for coupling includes:

a first plug secured to the center tube of the existing auger;

a second plug secured to the center tube of the auger attachment; and a bolt extending through the first plug and the second plug to couple the hollow center tube of the auger attachment to the center tube of the existing auger so that rotation of the existing auger causes granular material to be rotatably conveyed by the spiral auger flight about the hollow center tube of the auger attachment to filter fine particles from the granular material.

14. The auger attachment of claim 13 including an interior spiral auger flight within the hollow center tube, wherein the interior spiral auger flight is coupled to the existing auger so that rotation of the existing auger rotates the interior spiral auger flight to discharge fine particles from the interior of the center tube out the outlet of the center tube.

15. In a granular material conveying apparatus configured for rotatably conveying granular material about an axis in a longitudinal direction along the axis, an improvement comprising:

a hollow center tube coaxially centered about the axis, the center tube having an outlet, an exterior, an interior, and a plurality of perforations for communicating between the exterior and the interior so that as the granular material is rotatably conveyed about the hollow center tube, fine particles from the granular material migrate through the perforations into the interior of the hollow center tube.

16. A method for filtering fine particles from granular materials, the method comprising:

supplying granular material adjacent an exterior of a hollow center tube having a plurality of perforations communicating between the exterior and an interior of the hollow center tube;

rotatably conveying the granular material around the hollow center tube so that fine particles from the granular material migrate through the perforations into the interior of the hollow center tube; and discharging the fine particles from the interior of the center tube out an outlet of the center tube.

* * * * *

UNITED STATES PATENT AND TRADEMARK OFFICE

CERTIFICATE OF CORRECTION

PATENT NO. : 5,398,814

DATED : March 21, 1995

INVENTOR(S) : SYLVAN H. SIME

It is certified that error appears in the above-indentified patent and that said Letters Patent is hereby corrected as shown below:

Col. 2, line 31, delete "Outlet-32", insert --Outlet 32--

Col. 3, line 8, delete "beating", insert --bearing--

Signed and Sealed this

Thirteenth Day of June, 1995

*Attest:*

Bruce Lehman

BRUCE LEHMAN

*Attesting Officer*

*Commissioner of Patents and Trademarks*